US006040509A

United States Patent [19]

Fanella

[11] Patent Number: 6,040,509

[45] Date of Patent: Mar. 21, 2000

[54] ERGONOMIC POSITIONING APPARATUS FOR GUITAR OR LIKE INSTRUMENTS

[76] Inventor: Keith Fanella, 40-21 Kuiken Ter., Fair Lawn, N.J. 07410

[21] Appl. No.: 09/036,506

[22] Filed: Mar. 6, 1998

[51] Int. Cl.[7] ..... G10D 3/00

[52] U.S. Cl. ..... 84/280; 84/281; 84/327

[58] Field of Search ..... 84/278–281, 327, 84/421

[56] References Cited

U.S. PATENT DOCUMENTS

| | | | |
|---|---|---|---|
| 2,061,464 | 11/1936 | Heimers | 84/280 |
| 3,955,461 | 5/1976 | Ivie | 84/327 |
| 4,279,367 | 7/1981 | Jacobs | 224/257 |
| 4,656,917 | 4/1987 | Van Halen | 84/327 |
| 4,799,610 | 1/1989 | Hseih | 224/266 |
| 4,930,695 | 6/1990 | Thompson et al. | 224/257 |
| 5,332,137 | 7/1994 | Vielette | 224/257 |
| 5,400,683 | 3/1995 | LaFlame | 84/421 |
| 5,483,860 | 1/1996 | Adams | 84/327 |
| 5,573,158 | 11/1996 | Penn | 84/265 |
| 5,596,158 | 1/1997 | Tonon | 84/327 |
| 5,616,874 | 4/1997 | Kraus | 84/327 |
| 5,691,492 | 11/1997 | May | 84/421 |

*Primary Examiner*—Robert E. Nappi
*Assistant Examiner*—Marlon T. Fletcher
*Attorney, Agent, or Firm*—Richard M. Goldberg

[57] ABSTRACT

A guitar or like instrument harness apparatus which suspends the instrument (50) upon a player (60) and enables precise control and subtle manipulation of the instrument position in relation to the body and in a closer accordance with the principles governing proper body mechanics. The apparatus utilizes three separate movable clamp anchors (40) designed to be attached about the main body of the instrument (50). The apparatus contains male end quick-lock-release clasps (42). Two separate strap assemblies; a double-shoulder strap assembly (20) and a double-back strap assembly (30) interconnect with each other and assume position on the player (60). The front ends of the shoulder straps (26) are separately connected to a chest cross member (22) which contains sliding strap displacement guide members (28) for controlling the displacement of the shoulder straps (26) upon the player's shoulders. Cross member (22) and back strap ties (36) contain female end quick-lock-release clasps (24) which interconnect with their coinciding male counterpart clasps (42) located on clamp anchors (40). Adjustments for changing instrument position in relation to a player's body (60) can be accomplished by changing the lengths of back strap ties (36) and shoulder strap ties (27) and by changing the placement of the clamp anchors (40) upon the instrument (50). A further optional device—a guitar body displacing unit (70)—can be attached by suction cups (80) to the back of the main guitar body (50) to further enhance oblique displacement of the instrument (50) from the torso of the player (60), and to further assist in adjusting the angle of the fretboard playing surface (54) obliquely, and rotationally along its axis.

20 Claims, 7 Drawing Sheets

ERGONOMIC POSITIONING APPARATUS FOR GUITAR OR LIKE INSTRUMENTS

BACKGROUND—FIELD OF THE INVENTION

This invention relates to a musical instrument support, and specifically to a strap-like harness for positioning guitars or like instruments about the body of a player.

BACKGROUND—DESCRIPTION OF PRIOR ART

Players of guitars, specifically, electric and steel string acoustic type guitars, commonly use a strap to support the instrument over one's shoulder. These straps are usually connected by their ends to the instrument body by the use of two anchors inserted within the instrument. The placement of these two anchors within electric and steel string acoustic guitars has always remained relatively the same; one inserted in the bottom of the instrument and the other inserted in the upper left side of the instrument in the vicinity of the attachment of the elongated stringed neck to the body.

Classical guitars traditionally are not made with strap anchors since the complex classical repertoire is played from a sitting position. The main reason for this is to give the player the ability to make numerous subtle changes of instrument positioning to achieve a proper balance and security of the instrument relative to the player's body. Playing classical guitar in a standing position is unheard of since the instruments themselves have no strap anchors. Although it is possible to insert anchors into a classical guitar, the use of conventional strap harnesses would not enable the instrument to be properly positioned relative to a player's body according to classical guitar technique standards. Furthermore, drilling of hand-crafted classical guitars to insert anchors would damage their acoustical properties. And since many high quality instruments are worth thousands of dollars, such modifications would decrease their value.

The use of a standard single strap dual anchor system has many limitations. It is not possible to fully manipulate the instrument's position in relation to a player's body. In respect to the variable range of instrument positioning using this system, the following disadvantages occur:

(a) While the instrument can be vertically adjusted by changing the strap length, the angle of the elongated neck along its periphery cannot be adequately adjusted.

(b) It is not possible to adjust the angle of the fretboard surface along its axis in a rotational manner or obliquely.

(c) It is not possible to adjust the angle of the elongated neck obliquely, to a raised position along its periphery and/or rotationally, similiar to the way a cellist positions their instrument and maintain that position without undue muscular effort.

(d) It is not possible to raise or lower the main body of the instrument without also raising or lowering the fretboard playing surface of the elongated neck in the same direction.

(e) It is not possible to pull the upper right side section of the instrument body in and upward towards the player's body.

(f) It is not possible to pull the instrument upward in the direction of the shoulder not bearing the strap.

(g) It is not possible to achieve even weight distribution of the instrument upon both shoulders.

(h) Since anchors are traditionally not built into classical guitars, the use of a standard strap and anchor system would require instrument modification detrimental to the value of the instrument.

(i) Since inserted anchors remain in a permanently fixed position, they have less utility in respect to position adjustment function.

(j) It is not possible to achieve proper ergonomic positioning of the instrument in accordance with the principles governing proper body mechanics systems, such as the Alexander Technique or the Feldenkrais method of movement through awareness.

The basic underlying axiom represented by systems of body mechanics is to offer a more rational and efficient way of movement. These methods are well known by persons with a professional interest in their bodies—musicians, dancers, and actors. Proper ergonomic positioning of a musical instrument relative to a player's body and in closer accordance with the principles of proper body mechanics facilitates a player's technique. This can only truly be understood by someone skilled in the art. Improper positioning of instruments and the accompanying body movements carry the risk for potential injury. Unfortunately, this is all too common. This can easily be seen in teaching guitar to children since they struggle to understand and maintain a balanced instrument position. In regards to ergonomics and balanced positioning of stringed instruments in general, standard cello playing positioning represents a good model, a reason why all cellists position their instruments virtually in the same manner. The fretboard surface remains at an oblique angle from the player in the direction from their head towards their knees in a sitting position, a position which affords clear visibility and accessability to the fretboard playing surface in a well defined, ergonomically balanced position, a position that guitarists cannot nearly possibly achieve with any prior-art methods.

In respect to guitar, proper ergonomic positioning is more likely to be understood by accomplished classical guitarists whose understanding of such principles is a requirement for acquiring a professional technique. There has not been a great demand to play classical guitar in a standing position nor in a sitting position without the use of devices which prop the instrument into correct position. Classical guitar technique is employed in a sitting position and differs substantially from electric and steel string acoustic guitar playing technique. Thus, prior strap harness systems which relate solely to electric and steel string acoustic guitars, cannot accomplish the specifics related to classical guitar technique, i.e., proper ergonomics of instrument positioning in relation to a player's body which helps a player acquire a professional technique.

Thereafter, seeing a need for more control of instrument positioning in relation to a player's body, numerous new straps and ways to attach them to the instrument have been created. U.S. Pat. No. 5,596,158 to Tonon (1997) discloses a three-point anchor system in which a small adjustable strap, attached at the upper left hand anchor, attaches to the main strap which connects from the bottom anchor on the main body to an anchor in the vicinity of the headstock. However, this system offers no solutions for the malfunctions stated above. Most notably, malfunctions (b), (e), (f), (g), and (j) alone are the main deficiencies in Tonon. Furthermore, the pull on the headstock can cause intonation problems.

U.S. Pat. No. 5,332,137 to Violette (1994) also discloses a three-point anchor system. However, the harness comprises a waist belt and only one shoulder strap. Furthermore, the third anchor is to be inserted within the instrument. Thus, one could not use this system on hand-crafted classical guitars. It also cannot evenly distribute weight of the instrument upon both shoulders. It cannot facilitate pull of the instrument in the direction of the shoulder not bearing the strap. The third anchor and its connection to the waistband cannot facilitate pull from this section of the instrument upward and back. It is not possible to approximate a cello playing position or achieve proper ergonomic positioning of the instrument in accordance with the principles governing proper body mechanics.

U.S. Pat. No. 4,656,917 to Van Halen (1987) also discloses a three-point anchor system which includes a strap that connects from the bottom anchor to an anchor in the vicinity of the headstock, and an intermediate hinged shelf support on the back of the main guitar body. This hinged shelf is permanently affixed by blocks screwed into the main body. Thus, it cannot be used upon a classical guitar without causing detrimental modifications, nor does it allow one to reposition its placement. Thus, it doesn't allow a player to precisely choose where the plate rests upon the body. Furthermore, it can only lock into a ninety degree angle for the purpose of positioning the guitar perpendicular to the player. Thus, it does not afford one an adjustment for setting the guitar displaced at any other desired angle, nor does it have a pivoting pad which is necessary when angular displacement of the instrument resting on a player's body is desired. More generally, Van Halen's device affords no solutions for malfunctions (a–j) above.

Similarly, U.S. Pat. No. 3,955,461 to Ivie (1976) discloses an instrument stabilizer in which a rod member resting against the trunk of a player protrudes and connects to a mounting member attached to the back of the instrument body for the purpose of displacing the instrument from a player. However, it has a socket member mounted in the body of the instrument in which the other members of the device detach. This permanently affixed socket member indicates that it cannot be repositioned, nor can it be used without causing detrimental modifications to the instrument.

Several other types of alternative strap systems have been proposed. For example, U.S. Pat. No. 4,279,367 to Jacobs (1981) discloses a strap attached to the main body of a guitar at a first anchor point by a combined fitting. A further fitting is joined to the guitar at a second anchor point with an intermediate buckle adjustment, unconnected to the guitar, for controlling the extent to which the strap can be displaced from the body of the guitar. Jacobs fails to achieve pull of the upper right section of the main body towards the player. It also cannot achieve pull of the instrument in the direction of the shoulder not bearing the strap. It is not possible to achieve even weight distribution of the instrument upon both shoulders, nor adjust the angle of the fretboard surface rotationally or obliquely. The device in U.S. Pat. No. 5,483,860 to Adams (1996) manifests the same malfunctions. U.S. Pat. No. 4,930,695 to Thompson (1990) discloses a strap harness which achieves even weight distribution upon both shoulders and facilitates pulling the instrument in the direction upward both shoulders. However, it affords no pull of the upper right side section of the instrument towards one's body. Thus, it is not possible to adjust the angle of the fretboard surface rotationally or obliquely.

U.S. Pat. No. 5,616,874 to Kraus (1997) discloses a method of securing a guitar to a player's body. However, it is solely made for acoustic guitars. Furthermore, its title "Sitting Position Musical Instrument Retainer" indicates that it cannot be used in a standing position.

All prior-art strap harnesses used in conjunction with either a two or three-point anchor system cannot facilitate proper ergonomic positioning of a string instrument relative to a player's body. None can help a guitarist approximate a cello playing position. Furthermore, since they require insertable type anchors, they all fail to specifically address the problem of use with classical guitars where, as stated, instrument modification is required for anchor installation but detrimental to its value.

OBJECTS AND ADVANTAGES

Accordingly, it is one object of the invention to provide a device which properly positions a string instrument relative to a player's body. It is also an object to provide this function with classical, electric, and steel string acoustic guitars. Further objects and advantages of my invention are:

(a) to provide adequate control of the angle of the elongated neck of a string instrument along its periphery to a position similar to standard cello playing position, (b) to provide adequate control of the angle of the fretboard playing surface of a string instrument obliquely and rotationally along its axis, similar to standard cello playing position, (c) to provide adequate angular control of a string instrument's elongated neck obliquely, along its periphery, and rotationally while maintaining that desired position without undue muscular effort, (d) to provide more than mere vertical control of positioning a string instrument relative to a player's body so as to offer a greater variety of instrument positioning relative to one's body, (e) to provide pull from the upper right side section of a string instrument body in and upward toward a player's body, thereby to further facilitate a position adjustment function, (f) to provide pull of a string instrument upward in the direction over either or both shoulders, thereby to further facilitate a position adjustment function, (g) to provide even weight distribution of a string instrument upon both shoulders, (h) to provide a string instrument support system that encompasses the use of clamp anchors which do not detrimentally modify the instrument, (i) to provide a system that encompasses the use of movable anchors to further facilitate a position adjustment function of a string instrument relative to a player's body, (j) to facilitate the suspension of a classical guitar in a standing or sitting position and in accordance with classical guitar technique standards, (k) to facilitate the suspension of classical, electric, and steel string acoustic guitars in a standing or sitting position and in closer accordance with the principles governing proper body mechanics and ergonomics, (l) to enable a player to position electric and steel string acoustic guitars according to classical guitar technique standards, in a standing or sitting position, (m) to facilitate the suspension of classical, electric, and steel string acoustic guitars in a standing or sitting position by means of a three-point anchor harness system and without the need for drilling into the instrument's body to insert strap anchors, (n) to facilitate achieving a balanced position of a string instrument in relation to the body and to approximate standard cello playing position, and (o) to aid children in understanding and maintaining a balanced position while playing a string instrument.

Further objects and advantages of the preferred embodiment will become apparent from a consideration of the drawings and ensuing description.

Figure 1:
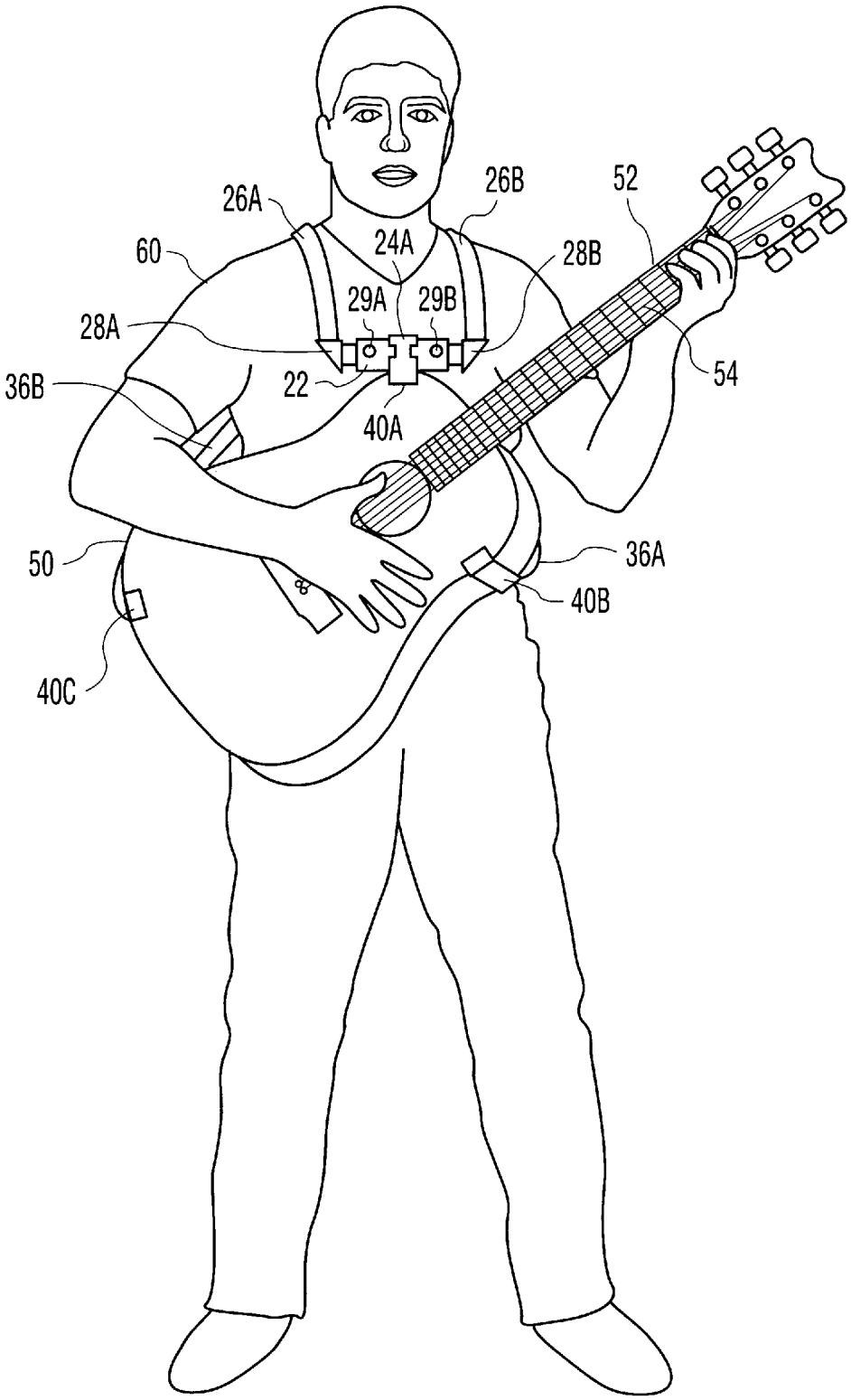
FIG. 1 is a front perspective view of a guitar positioning apparatus according to the preferred embodiment of the invention in use by a player with an acoustic guitar.

| Reference Numerals in Drawings | |
|---|---|
| 20 | double-shoulder strap assembly |
| 22 | chest cross member |
| 23 | guide holes |
| 24 | female quick-lock-release clasps |
| 25 | guide posts |
| 26 | shoulder straps |
| 27 | shoulder strap ties |
| 28 | shoulder displacement guide members |
| 29 | guide post locking thumbscrews |
| 30 | double-back strap assembly |
| 32 | double-back strap main member |
| 34 | strap length adjustors |
| 36 | female quick-lock-release back strap ties |
| 40 | male quick-lock-release clamp anchors |
| 41 | gripping pads |
| 42 | male quick-lock-release clasps |
| 43 | plyably stiff piece |
| 44 | moving clamp member |
| 45 | main clamp housing |
| 47 | threaded thumbscrew |
| 48 | fastening plate |
| 50 | playing instrument |
| 52 | elongated neck of instrument |
| 54 | fretboard playing surface |
| 60 | player |
| 70 | guitar body displacing unit |
| 72 | main frame |
| 74 | subordinant frame |
| 75 | locking hinge knob |
| 76 | pivoting plate |
| 77 | padding |
| 78 | pivoting pin |
| 79 | pin receptacles |
| 80 | suction cups |

FIGS. 1 & 2—FRONT AND BACK VIEWS

Figure 2:
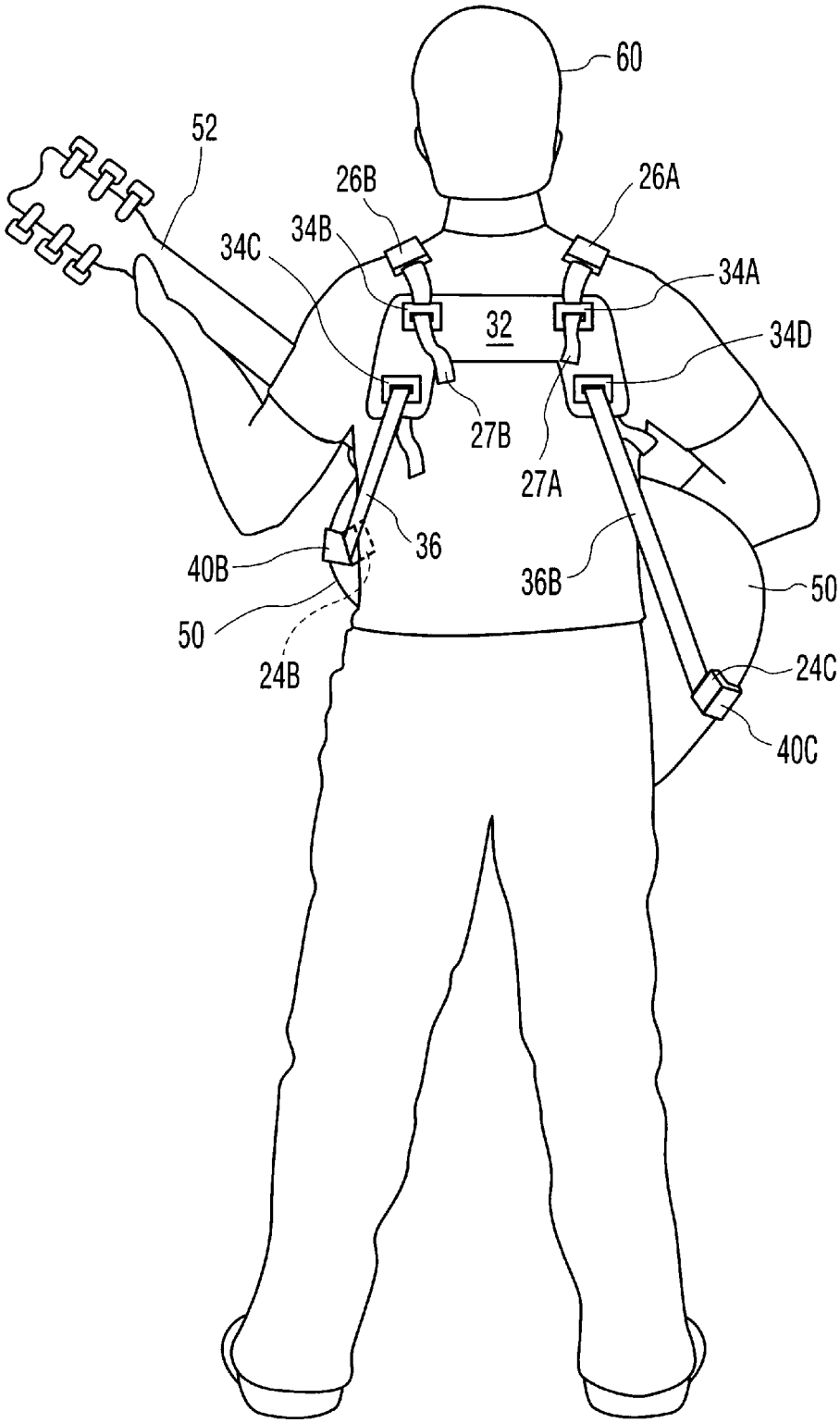
FIG. 2 is a rear perspective view of the positioning apparatus of FIG. 1.

FIGS. 1 and 2 show front and back perspective views, respectively, of player 60 utilizing the apparatus with a classical-type guitar and with all component members assembled and interconnected. Instrument 50 is shown with movable clamps 40 secured at three different positions around its perimeter. At the approximate positions shown, clamp 40*b* and strap tie 36*a* mainly maintain pull of the upright angle of elongated neck 52 along its periphery, obliquely, and rotationally (FIG. 2). FIG. 1 shows displacement members 28 pulled out from cross member 22 approximately half way. Shoulder straps 26 rest comfortably upon the shoulders of player 60 in a position desired. Player 60 is shown holding instrument 50 in a balanced position and has adequate access to fretboard playing surface 54 physically and visually without contorting the neck or wrists and without causing undue tension.

DESCRIPTION—FIG. 3—EXPLODED VIEW

Figure 3:
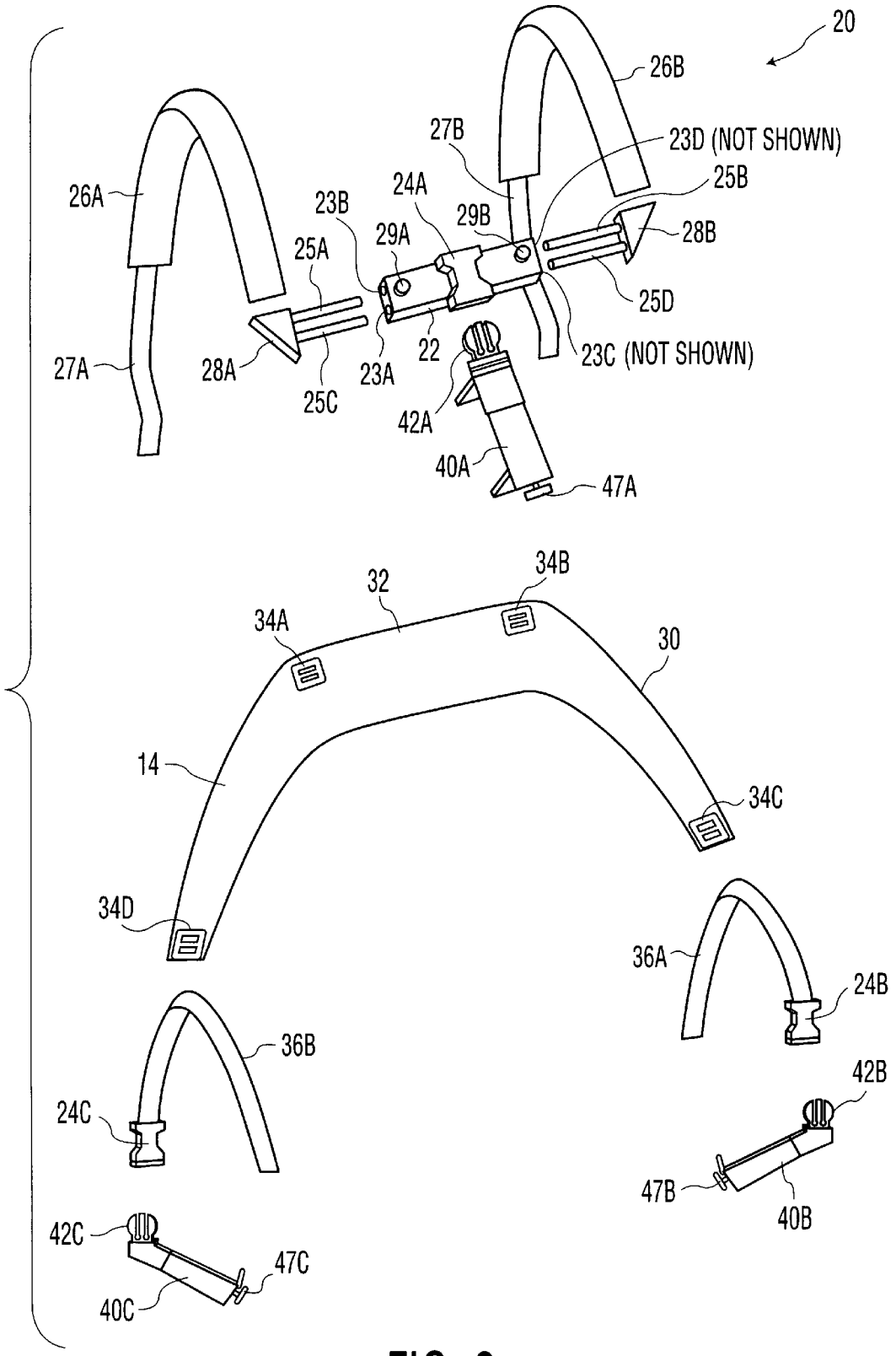
FIG. 3 is a perspective exploded view of the components of the apparatus.
Figure 8:
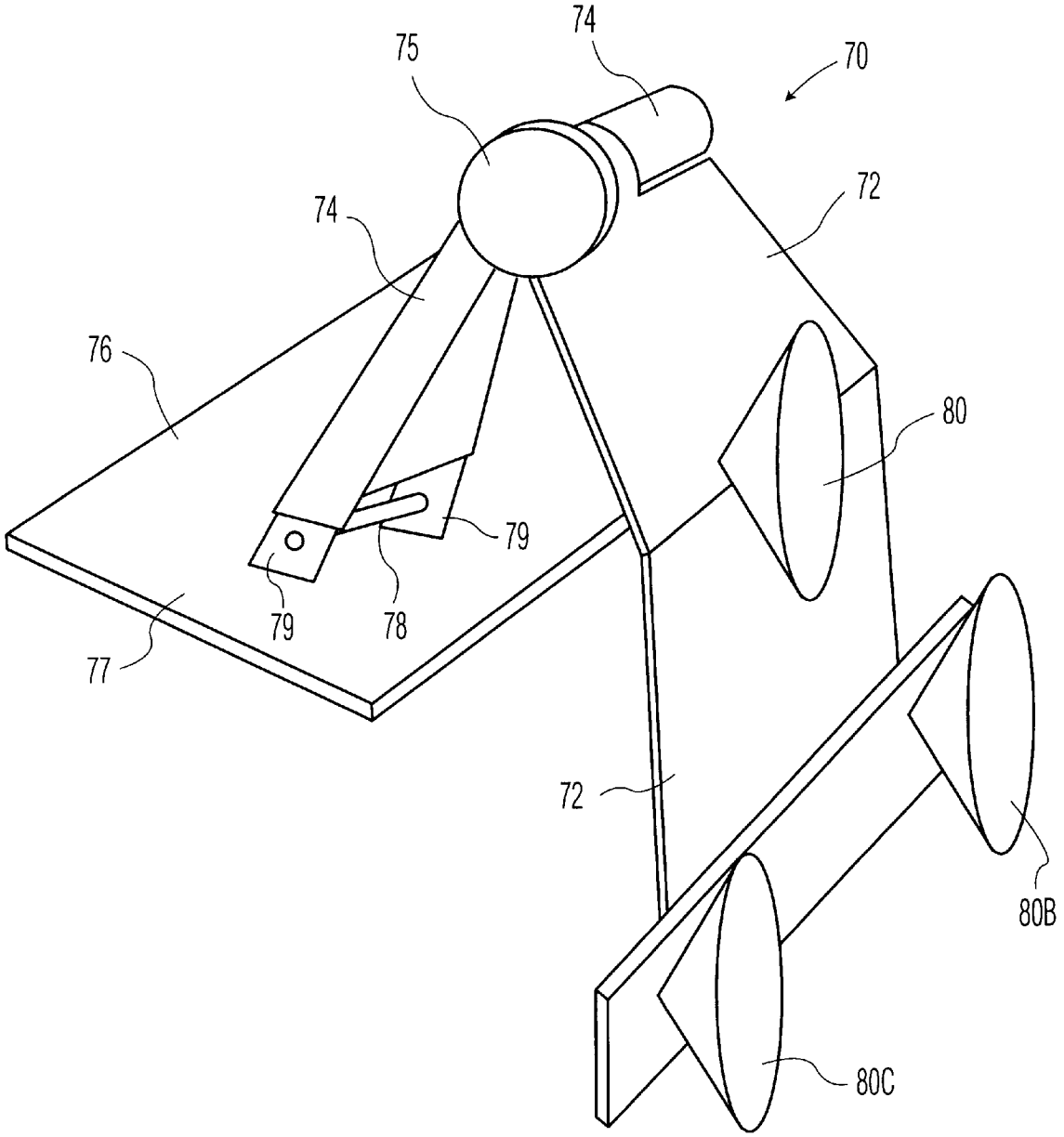
FIG. 8 is a perspective view of a guitar displacing unit.

FIG. 3 shows a perspective view of a musical instrument harness apparatus constructed in accordance with the invention showing the component members prior to interconnection. The apparatus comprises a double-shoulder strap assembly 20 (detailed in FIG. 4), a double back-strap assembly 30 (detailed in FIG. 5), and three movable clamp anchors 40 (detailed in FIG. 6). FIG. 8 shows a guitar body displacing unit 70, which is also part of the apparatus. However, since it is an optional device and not interconnected with any part of the apparatus of FIG. 3, it will be discussed accordingly.

FIG. 4—FRONT PERSPECTIVE VIEW

Figure 4:
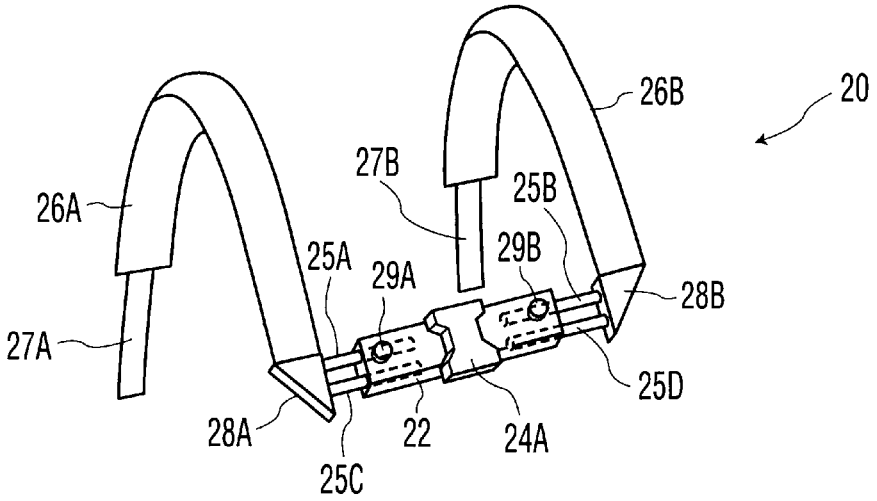
FIG. 4 is a front perspective view of a double-shoulder strap assembly and its assembled component members.

FIG. 4 shows a front perspective view of double-shoulder strap assembly 20 assembled. Assembly 20 comprises a rigid chest cross member 22 which can be made of plastic, aluminum, wood, or any rigid material. Cross member 22 contains a female quick-lock-release clasp 24*a* affixed to its front center, two guide post locking thumbscrews 29, also located on the front, and four guide post holes 23, two on each of its sides as depicted in FIG. 3. Locking thumbscrews 29*a* and 29*b* screw down through guide post holes 23*b* and 23*d*.

Assembly 20 also comprises two shoulder straps 26, two shoulder strap ties 27, and two rigid strap displacement guide members 28. Each guide member 28 contains two guide posts 25 as shown separated from cross member 22 in FIG. 3. Shoulder straps 26 can be affixed to displacement members 28 by sewing or any other fastening method. Strap ties 27*a* and 27*b* can be of nylon webbing and can be integrally affixed to the ends of shoulder straps 26 by sewing or by any other method of attaching.

FIG. 5—BACK PERSPECTIVE VIEW

Figure 5:
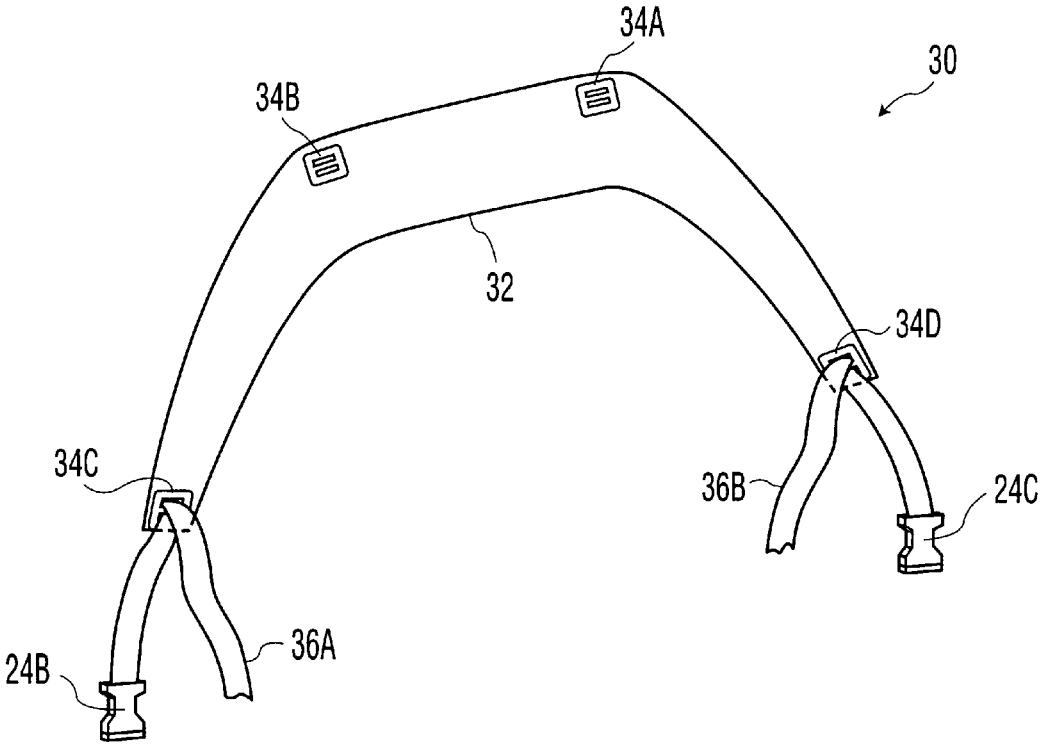
FIG. 5 is a back perspective view of a double-back strap assembly and its assembled component members.

FIG. 5 depicts a back perspective view of double-back strap assembly 30 assembled. It comprises a double-back strap main member 32, four strap-length adjustors 34, and two back strap ties 36 of material consistent with that of shoulder strap ties 27 and with female quick-lock-release clasps 24*b* and 24*c* affixed to their ends by sewing or any other fastening method. Back member 32 is wide enough across the top, as shown in FIG. 2, so as to naturally receive shoulder strap ties 27 straight on and short enough so that strap adjustor 34*c* is not too low upon one's back for reasons explained below. The inside of back member 32 preferably can be of any non-slip type material, such as rubbery foam, leather, etc., to aid in keeping it stationary upon the back of player 60. All strap ties 27 and 36 are depicted in FIGS. 2, 3, 4, and 5 as being narrower than shoulder straps 26. This is particularly preferred since a wider strap tie may interfere with a player's fretboard hand during playing, depending upon the position secured by clamp anchor 40*b*.

FIG. 6—MOVABLE CLAMP ANCHOR

Figure 6:
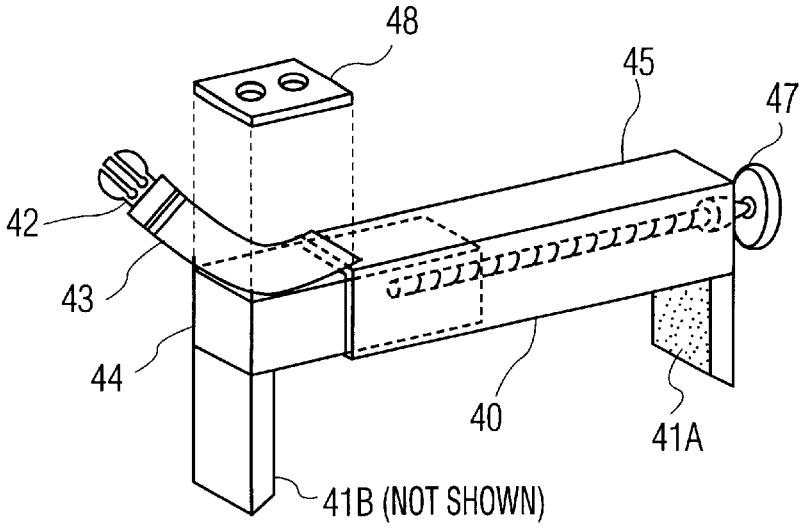
FIG. 6 is a perspective view of a movable clamp anchor and its component members.

FIG. 6 shows a perspective view of a male quick-lock-release clamp anchor 40. It comprises a movable clamp member 44 guided within a main clamp housing 45 by a threaded thumbscrew 47. Gripping pads 41 are affixed to the inner walls of the clamping surfaces and a male end quick-lock-release clasp 42 is attached with nylon webbing or any plyably stiff material 43 on top of housing 45 and secured with a fastening plate 48 or any other method of attatchment. Male clasp 42 is attached on top of housing 45 approximately the length of male clasp 42 itself inward from the end opposite thumbscrew 47.

FIG. 7—CLAMP ANCHOR SECURED ON GUITAR

Figure 7:
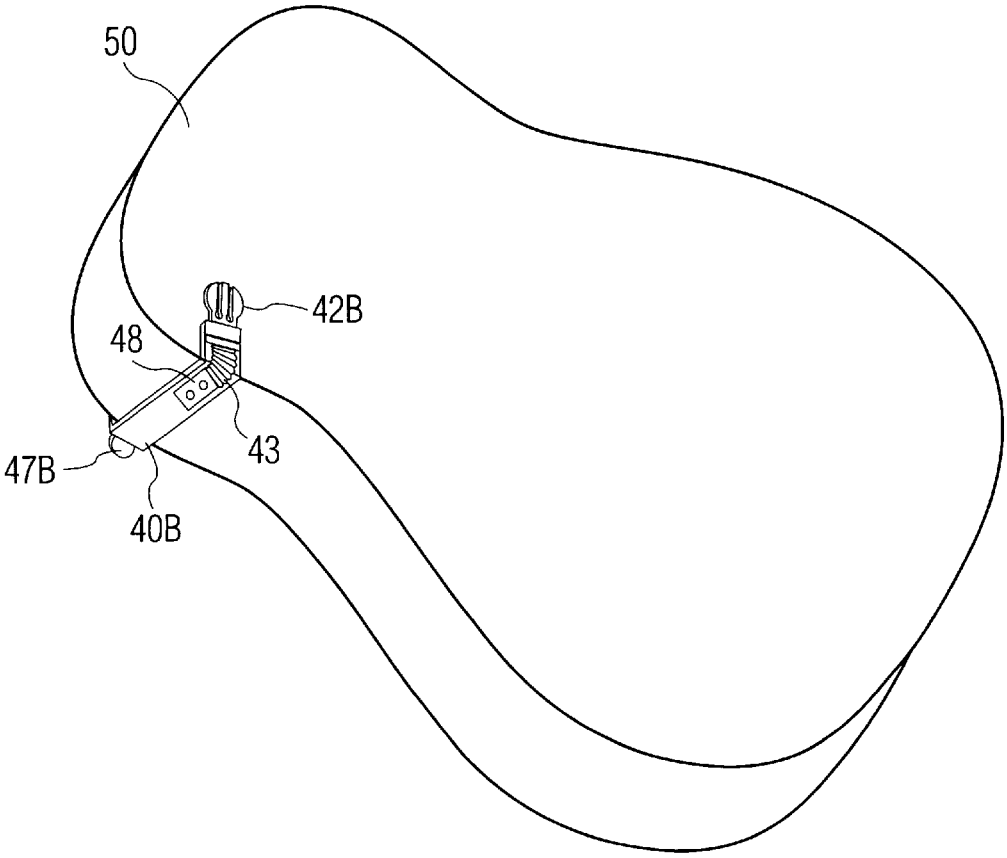
FIG. 7 is a perspective view of the movable clamp anchor of FIG. 6 anchored to the main body of a guitar.

FIG. 7 shows clamp anchor 40*b* secured to instrument 50. Male clasps 42 remain flexible so they can pull in any direction. Clasp 42*b* is shown fixed in a position pointing out the back of instrument 50. As on all clamp anchors 40, plyably stiff material 43 prevents clasps 42 from dangling. It flexibly maintains clasps 42 in a position that allows a player with one hand to easily interconnect clasps 42 to their coinciding counterpart clasps 24.

FIG. 8—OPTIONAL DISPLACING UNIT

FIG. 8 shows a perspective view of an optional guitar displacing unit 70. It comprises a main frame 72 specifically angled in design. It contains three suction cups 80, and a subordinate frame 74 which connects to main frame 72 by a hinging connection that movably adjusts and locks in place by a locking knob 75. The opposite end of subordinate frame 74 connects to a pivoting plate 76 which contains pin receptacles 79 centered about its structure. Plate 76 contains padding 77 on the side opposite receptacles 79. Plate 76 attaches to subordinate frame 74 with a pivoting pin 78 guided through the end of subordinate frame 74 and through receptacles 79.

FIG. 9—OPTIONAL DISPLACING UNIT IN USE

Figure 9:
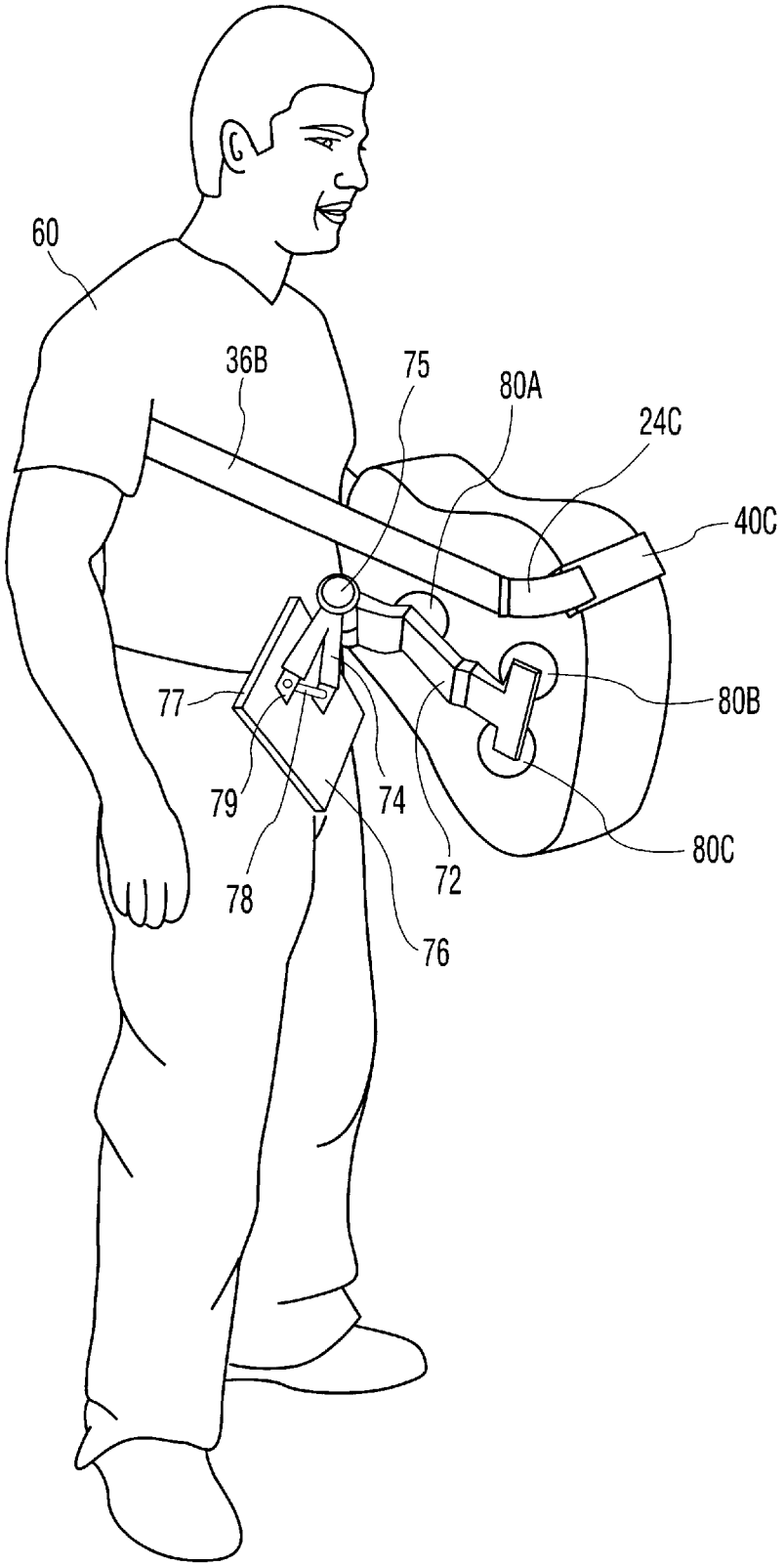
FIG. 9 is a side perspective view of a player using the optional displacing unit of FIG. 8, and showing an oblique angle made possible of a guitar in relation to one's body.

FIG. 9 shows unit 70 in use. Instrument 50 is shown set at an oblique angle from the body of player 60. This greatly enhances visual and physical access to fretboard surface 54. When obliquely positioned, player 60 can further adjust surface 54 rotationally by adjusting the pull of backstraps 36. This oblique angle closely approximates standard cello playing position with surface 54 angled from the head of player 60 toward the knees while sitting. If standing as shown if FIG. 9, the position is maintained.

OPERATION

Each anchor 40 (FIG. 6) is designed to be selectively attachable about the main body of instrument 50 with male clasps 42 facing out the back of instrument 50 (FIG. 7). Anchors 40*a*, 40*b*, and 40*c* attach to instrument 50 at the approximate location points depicted in FIG. 1. However, since these anchors 40 are movable, they can be set upon instrument 50 in a variety of positions to facilitate guitar position adjustment function. Once anchors 40 are in place, male clasps 42*a*, 42*b*, and 42*c* can remain plyably fixed in a position which easily facilitates quick interconnection to their respective counterpart female clasps 24 using one hand.

Shoulder-strap assembly 20 interconnects with back-strap assembly 30 via shoulder strap ties 27*a* and 27*b* looping through adjustors 34*a* and 34*b* as shown in FIG. 2. Female ties 36*a* and 36*b* interconnect with adjustors 34*c* and 34*d* located on back member 32 as shown in FIG. 5. In practice, assembly 20 and assembly 30, may remain interconnected. Together, interconnected strap assemblies 20 and are 30 fit over the head of player 60 and situated to a position as depicted in FIGS. 1 and 2. Female clasps 24 may then be attached to their male counterpart clasps 42 in any order. However, it is easiest to first connect female clasp 24*b* located on female tie 36*a* to its male counterpart clasp 42*b* located on clamp anchor 40*b*. This is because it will normally be the shortest of the two female ties 36. Then female clasp 24*a* located on the cross member 22 can connect to its male counterpart clasp 42*a* located on anchor 40*a*. Finally, female clasp 24*c* located on female tie 36*b* can connect to its male counterpart clasp 42*c* located on anchor 40*c*. The length of all four strap ties 27 and 36 may then be appropriately adjusted to accommodate the desired position of instrument 50 upon the body.

When assembled, posts 25 slide in and out of cross member 22 via their respective holes 23 as shown in FIG. 4 (holes not shown). Player 60 has the ability to individually adjust the placement of shoulder straps 26*a* and 26*b* within the shoulder/collarbone area. By loosening locking thumbscrews 29, guide members 28 can be pulled out of cross member 22 to a place desired and secured by tightening down locking thumbscrews 29*a* and 29*b* into posts 25*a* and 25*b* as depicted in FIG. 4. FIG. 1 shows displacement members 28*a* and 28*b* pulled out from cross member 22 approximately halfway. Player 60 can also control position adjustment of instrument 50 in the direction of either shoulder.

It is vital that back member 32 be positioned high upon the player's back as depicted in FIG. 2. Back member 32 is made so as to have adjustor 34*c* also positioned high upon the player's back or at least not too low. In this manner female tie 36*a* pulls instrument 50 back and up—important for the proper positioning function. Female tie 36*a* must do more than merely pull back: it must pull the instrument back and upward upon a player as shown in FIG. 2. Female tie 36*a* mainly controls the angle of elongated neck 52 along its periphery and rotationally along its axis.

The optional guitar body displacing unit 70, shown in FIG. 8, is to control the displacement of instrument 50 from the torso of player 60. It further enhances adjusting the angle of fretboard surface 54 obliquely and rotationally in relation to the player's body as shown in FIG. 9. Unit 70 is affixed to the back of instrument 50 by suction cups 80. Player 60 can position unit 70 according to the preferred position of unit 70 in relation to the player's body, i.e., to wherever player 60 desires plate 76 to rest upon the body. Suction cups 80 allow quick and easy repositioning of unit 70 if desired. Main frame 72 is angularly made so as to give access to hinge knob 75 while unit 70 is in use. The moving range of subordinate frame 74 goes from a closed position, where it contacts main frame 72, to a wide open position where the displacement of instrument 50 from a player can be up to approximately 30 cm. Plate 76 always remains comfortably in place with the player's body. The use of unit 70 affords player 60 a greater view of fretboard surface 54 and minimizes neck strain caused by leaning the head forward in order to see surface 54. Furthermore, it opens new avenues of technical advancement never possible before. It affords one the ability to approximate standard cello playing position and retain that position without undue muscular effort while sitting or standing (FIG. 9). The combination of placement of clamp anchors 40 upon instrument 50 and adjustments within strap assemblies 20 and 30 and displacing unit 70 provides choices of subtle positioning that are virtually endless.

Thus the musical instrument harness apparatus enables a player to manipulate their instrument position so that they may attain a better ergonomically balanced position of the instrument upon the body without undue strain. A greater range of position manipulation allows one to experience balance and movement of the limbs not possible before. A position in where the elongated neck is close to a player's head and angled obliquely allows full visual and physical coverage of the entire fretboard playing surface. The apparatus allows the instrument to be centered in relation to a player's body in which both shoulders remain relaxed and both wrists remain straight. The player does not have to contort the body or pull the instrument to reach any part of the fretboard playing area. This balanced position is in a closer accordance with better body mechanic principles of movement. This enables one to further rediscover their technique in order to reach higher levels of technical faculty. Through its use and practice, one can find how to function better with a minimum of strain and a maximum of awareness. The apparatus can enhance a guitarist's ability in achieving a higher integration of human responses that are simple, practical, and precise. These are the primary goals of the body mechanics systems. The player may sit or freely move about while effortlessly maintaining a sound position of the instrument in relation to the body. Furthermore, the apparatus may be used with acoustic and electric guitars alike and in particular, with classical guitars without the need to detrimentally modify the instrument.

While my above description contains many specificities, these should not be construed as limitations on the scope of the invention, but rather as an exemplification of one preferred embodiment thereof. Various modifications in its structure may be adopted without departing from the spirit of the invention.

For example, the shoulder and back assemblies can be made in different sizes so as to fit and function appropriately for different size people, particularly children. The assemblies may be made out of any material and working design in accordance with its functioning principles. All quick-lock-releases and their counterparts may be reversed. Other types of fastening devices may be used. The clamp anchors may be of any rigid type material, shape, or working structural design and can be made to fit any guitar size and shape accordingly such as, for example, a narrow bodied electric guitar or a thick bodied acoustic bass guitar. One clamp may be designed to encompass the fitting range of many guitars. They may be made of a streamlined design so as to minimize protruding parts emerging away from the instrument body, allowing the instrument to be closed in a case (depending on how tight the fit is, of course) without removing the clamps from the instrument.

When two traditional anchors are present in an electric or a steel string acoustic guitar and a player chooses to use one or both of those spots exactly for strap to guitar interconnection, the player may, instead of a clamp anchor, use the appropriate clasp affixed to nylon webbing (as known in the prior art) and attach it to the instrument body via the anchor holes.

The cross member and its adjusting displacement members can also be made of any rigid material and working design. A common distance of the shoulder straps from each other can be calculated and the displacement members could be eliminated. The guide posts may be made to fit tightly enough to hold their place but still retain the ability to slide them with enough force, thus eliminating the need for locking thumbscrews. A small notch and groove can be made along the guide posts and post hole tracks to prevent them from pulling out of the cross member. All of the parts in contact with a player's body may be comfortably padded by any method of padding.

The shoulder strap ties may be eliminated with the shoulder straps themselves being extended to the appropriate length. The strap length adjustors may be replaced by any loop-type hoops and the strap ties may contain the appropriate hook-and-loop patches affixed so that adjusting strap tie length can be facilitated by folding the strap tie, through the hoop, back onto itself, making a locking contact. Any method may be used to determine a prior strap length setting. One way is to have colored ring-bands on the strap ties so that the player may quickly relocate a particular setting if desired.

The optional displacing unit may also be made of any working design. The suction cups can be replaced by any type of clamping method and the dimensions encompassing its range of displacement can be made to any desired functional range.

Another embodiment for the shoulder and back assembly combination can be of a rigid frame of aluminum, for example, in where the whole embodiment fits on the wearer much as does an aluminum-framed backpack. Also, the three individual clamps can be adjustably joined by an intermediate frame along the back of the guitar body.

Thus the scope of the invention should be determined by the appended claims and their legal equivalents, rather than by the examples given.

I claim:

1. An apparatus for the suspension of a string instrument on a body of a player while the player is standing, the string instrument having a main body and a neck extending from said main body, said apparatus comprising:

(a) a strap-connector assembly including:

i) a shoulder strap assembly for extending over a person's shoulders, and ii) first, second and third release connectors secured to said shoulder strap assembly; and (b) first, second and third attachment devices for attachment at different respective securing positions to said main body of said instrument, each of said attachment devices including a mating connector for connecting to a respective said release connector of said strap-connector assembly, and at least one of said attachment devices including an anchoring device for adjustably attaching the respective attachment device to said main body at any of a plurality of desired locations at the respective securing position such that said string instrument can be set at a desired orientation and angle relative to said player's body.

2. The apparatus of claim 1 wherein:

(a) said shoulder strap assembly comprises:

i) left and right shoulder straps, each having first and second opposite ends, and ii) a rigid cross member having opposite ends connected to said first ends of said left and right shoulder straps, with said first release connector connected to said rigid cross member.

3. The apparatus of claim 2 wherein:

(a) said first ends of said left and right shoulder straps each include an attaching device for connecting to said opposite ends of said cross member, respectively, and (b) said opposite ends of said cross member include arrangements for connecting with said attaching devices.

4. The apparatus of claim 3 wherein said attaching devices slidably interconnect with said opposite ends of said cross member, respectively, such that said left and right shoulder straps are movable toward and away from each other.

5. The apparatus of claim 4 wherein said arrangements of said cross member further include at least one locking device for independently locking at least one said attaching device in a selected position.

6. The apparatus of claim 2 wherein said strap-connector assembly further includes a backstrap assembly connected with said opposite second ends of said left and right shoulder straps for mounting on a player's back, with said second and third release connectors secured to said backstrap assembly.

7. The apparatus of claim 6 wherein said backstrap assembly comprises:

(a) a main back member connected with said opposite second ends of said left and right shoulder straps, and (b) left and right back straps, each having first and second opposite ends, with the first ends thereof connected to said main back member and each second end thereof connected with a respective one of said second and third release connectors.

8. The apparatus of claim 7 wherein said back member includes left and right adjustable shoulder strap fastening arrangements for connecting with said second ends of said left and right shoulder straps, respectively, and for providing for independent adjustment of said left and right shoulder straps to a desired length.

9. The apparatus of claim 7 wherein said back member further includes a gripping surface so that said back member remains disposed upon said player's back without slipping.

10. The apparatus of claim 7 wherein said back member includes left and right adjustable back strap fastening arrangements for connecting with said first ends of said left and right back straps, respectively, and for providing for independent adjustment of said left and right back straps to a desired length.

11. The apparatus of claim 10 wherein said opposite second ends of said left and right back straps include said second and third release connectors for connecting to said mating connectors of said second and third attachment devices, respectively.

12. The apparatus of claim 1 wherein said first, second, and third attachment devices each further include a slightly flexible material for joining said mating connectors with said anchoring devices, such that said matings connectors remain in a set position after said slightly flexible material is moved by the player so that said release connectors can be connected to said mating connectors with only one hand by the player.

13. The apparatus of claim 1 wherein each said anchoring device includes a clamp for releasably securing the respective anchoring device onto said instrument without damaging or modifying said instrument.

14. The apparatus of claim 13 wherein each said clamp includes:

a substantially U-shaped body defined by spaced apart legs connected by a connecting leg, with at least one of said legs movable toward and away from the other of said legs, such that said legs can engage front and rear surfaces of the string instrument, and a tightening assembly for tightening said legs against said front and rear surfaces to releasably clamp said substantially U-shaped body to said string instrument at any desired position.

15. The apparatus of claim 1 wherein at least two of said first, second and third attachment devices include anchoring devices for adjustably attaching the respective attachment devices to said main body at any of a plurality of desired locations at the respective securing positions such that said string instrument can be set at a desired orientation and angle relative to said player's body.

16. The apparatus of claim 1 wherein all of said first, second and third attachment devices include anchoring devices for adjustably attaching the respective attachment devices to said main body at any of a plurality of desired locations at the respective securing positions such that said string instrument can be set at a desired orientation and angle relative to said player's body.

17. The apparatus of claim 1, further comprising a displacing unit operating separate and apart from said strap-connector assembly and said attachment devices, for controlling a distance of said instrument from the player's body, said displacing unit comprising:

(a) a first frame including a securing arrangement for securing said first frame to said instrument, (b) a second frame having a player's body engaging portion for directly engaging and pushing against the player's body, and (c) a securing arrangement for movably securing said second frame to said first frame such that said body engaging portion is movable toward and away from said first frame and for releasably locking said second frame in any of a plurality of different positions relative to said first frame.

18. The apparatus of claim 17, wherein said securing arrangement includes:

(a) a pivot assembly for pivotally connecting said second frame with said first frame, and (b) a tightening arrangement for releasably locking said second frame at a plurality of angles relative to said first frame.

19. The apparatus of claim 17, wherein said body engaging portion includes a padded plate.

20. The apparatus of claim 17, wherein said securing arrangement includes at least one suction cup for releasably securing said first frame to a rear surface of the instrument at a plurality of different positions.

* * * * *